United States Patent [19]

Kita

[11] Patent Number: 5,061,968

[45] Date of Patent: Oct. 29, 1991

[54] COLOR IMAGE FORMING MACHINE WITH INDIVIDUALLY DRIVABLE AGITATING MEANS

[75] Inventor: Hideki Kita, Suita, Japan

[73] Assignee: Mita Industrial Co., Ltd., Japan

[21] Appl. No.: 441,257

[22] Filed: Nov. 27, 1989

[30] Foreign Application Priority Data

Nov. 30, 1988 [JP] Japan ..... 63-300652

[51] Int. Cl.[5] ..... G03G 15/01

[52] U.S. Cl. ..... 355/326; 118/645; 355/245; 355/327

[58] Field of Search ..... 355/326, 327, 245, 251, 355/253; 118/645, 653, 656, 657, 658

[56] References Cited

U.S. PATENT DOCUMENTS

| | | | |
|---|---|---|---|
| 3,987,756 | 10/1976 | Katayama et al. | 355/327 |
| 4,579,443 | 4/1986 | Abuyama et al. | 355/326 |
| 4,652,113 | 3/1987 | Watanabe | 355/326 |
| 4,801,966 | 1/1989 | Ikeda | 355/245 |
| 4,841,329 | 6/1989 | Kasamura et al. | 355/326 |
| 4,860,053 | 8/1989 | Yamamoto et al. | 355/326 |
| 4,958,191 | 9/1990 | Yamada et al. | 355/245 |

FOREIGN PATENT DOCUMENTS 266946 5/1988 European Pat. Off. .

287122 10/1988 European Pat. Off. .

OTHER PUBLICATIONS

European Search Report for European Patent Application 89312354.7 and Annex to the European Search Report.

*Primary Examiner*—A. T. Grimley
*Assistant Examiner*—Thu A. Dang
*Attorney, Agent, or Firm*—Beveridge, DeGrandi & Weilacher

[57] ABSTRACT

A color image-forming machine including a developable member which is movable through a developing zone, a device for forming a latent electrostatic image on the developable member, and a developing device for developing the latent electrostatic image formed on the developable member is disclosed. The developing device includes a movable frame member, a device for moving the movable frame member, and a plurality of development mechanisms mounted on the movable frame member. By moving the frame member, each of the development mechanisms can be positioned selectively in the developing zone. The development mechanisms are provided with developers which contain different color toners. A developer agitator is provided for each of the development mechanisms.

16 Claims, 9 Drawing Sheets

COLOR IMAGE FORMING MACHINE WITH INDIVIDUALLY DRIVABLE AGITATING MEANS

FIELD OF THE INVENTION

This invention relates to a color image-forming machine such as a color copying machine or a color printer, and more specifically, to a color image-forming machine including a developing device for developing a latent electrostatic image comprising a plurality of development mechanisms containing toners of different colors.

DESCRIPTION OF THE PRIOR ART

In recent years, with an increasing demand for color images, a color image-forming machine of the electrostatic type has been proposed and come into commercial acceptance. A typical example of the color image-forming machine of the electrostatic type includes an electrostatic photosensitive member which is disposed on a supporting substrate in the form of a rotating drum or an endless belt and is moved along an endless moving passage passing successively through a latent electrostatic image-forming zone, a developing zone, a transfer zone and a cleaning zone. The image-forming machine further comprises a latent electrostatic-forming means for forming a latent electrostatic image on the photosensitive member in the latent electrostatic image-forming zone, a developing means for developing the latent electrostatic image on the photosensitive member to a toner image in the developing zone, a transfer means for transferring the toner image on the photosensitive member to a receptor sheet which may be plain paper in the transfer zone, and a cleaning means for removing the residual toner on the photosensitive member in the cleaning zone.

The developing device generally includes a stationary frame member, a movable frame member mounted movably on the stationary frame member, a movable frame member moving means for properly moving the movable frame member and a plurality of development mechanisms mounted on the movable frame member, each of the development mechanisms being adapted to be selectively positioned in the developing zone by the movement of the movable frame member. Toners of different colors are filled respectively in the individual development mechanisms. In replacing the development mechanism positioned in the developing zone, the above control means usually stops movement of the electrostatic photosensitive member (and therefore, the rotation of the rotating drum or endless belt) before it starts to move the movable frame member (therefore, before it starts to move a specific development mechanism positioned in the developing zone from the developing zone), and after stopping the movement of the movable frame member (and therefore, after the next development mechanism is positioned in the developing zone), starts to move the electrostatic photosensitive member (and therefore, rotate the rotating drum or endless belt) in order to prevent scattering of the developer filled in the development mechanism to be moved from the developing zone and in the development mechanism to be positioned in the developing zone by the movement of the electrostatic photosensitive member.

The conventional color image-forming machine has the following problems to be solved.

Firstly, if each of the development mechanisms is of the type including an agitating means for agitating a developer therein, it is desired to pre-agitate ("age") the developer by starting the driving of the agitating means in each of the development mechanisms. However, in the conventional color image-forming machine, the above pre-agitation (aging) considerably prolongs the time required to perform the color image-forming process, and therefore, the increasing of the speed of color image formation is obstructed.

Secondly, for good development by each of the development mechanisms in the developing device, it is important to position the movable frame member at a plurality of required positions precisely in succession, and to position each of the development mechanisms successively and precisely in the developing zone. In the conventional color image-forming machine, however, each of the development mechanisms cannot be stably and precisely positioned at the developing zone, or a complex and expensive mechanism is required to position each of the development mechanisms precisely in the developing zone.

Thirdly, in a development device of the type in which the development mechanisms are successively positioned in the developing zone by moving the movable frame member, it is critical that when the movable frame member is stopped at a predetermined position and a specific development mechanism is positioned in the developing zone, this development mechanism should be maintained in a required operative relation with respect to a member to be developed, such as the electrostatic photosensitive member. On the other hand, during movement of the movable frame member, it is desired that all of the development mechanisms should be isolated from the member to be developed and should not interfere with the member to be developed. If during movement of the movable frame member, the specific development mechanism interferes even a little with the member to be developed, the movable frame member and the development mechanisms mounted on it cannot be moved smoothly. However, the conventional color image forming machine cannot, without requiring various complex and expensive mechanisms, meet the desired requirement that the development mechanisms should be maintained in a required operative relation with respect to the member to be developed only when they are positioned in the developing zone, and in other instances, they should be sufficiently isolated from the member to be developed, and prevented accurately from interfering undesirably with it.

Fourthly, in the conventional color image forming machine, part of the toner of a development mechanism previously positioned in the developing zone remains on the surface of the electrostatic photosensitive member, and is likely to get mixed with the toner of the next development mechanism to be positioned in the developing zone.

SUMMARY OF THE INVENTION

It is a first object of this invention to provide an improved color image-forming machine of the type in which an agitating means for agitating the developer is disposed in each of a plurality of development mechanisms in a developing device, in which the developer can be preliminarily agitated by starting the driving of the agitating means in each development mechanism, without prolonging the time required for carrying out the color image forming process, before a latent electrostatic image is developed to a toner image in each development mechanism.

It is a second object of this invention to provide an improved color image forming machine in which a plurality of development mechanisms can be stably positioned in a developing zone precisely without the need for a complex and expensive mechanism.

It is a third object of this invention to provide an improved color image forming machine, in which, without the need for a complex and expensive mechanism, each of a plurality of development mechanisms in a developing device is maintained in a required operative relation to a member to be developed, such as an electrostatic photosensitive member, and in other instances, it is sufficiently isolated from the member to be developed, and prevented accurately from undesirably interfering with it.

It is a fourth object of this invention to provide an improved color image forming machine in which even when toner from a development mechanism positioned previously in a developing zone remains on the surface of the electrostatic photosensitive member, the toner is accurately prevented from getting mixed with toner from the next development mechanism to be positioned in the developing zone.

The basis of the invention which achieves the first object is that a movable frame in a developing device is provided with a driving source and a drive-connecting means for drivingly linking the driving source with an agitating means of each of a plurality of development mechanisms, and even during the movement of the movable frame, the agitating means in each of the development mechanisms can be driven.

The first object is thus achieved by a color image-forming machine comprising a member to be developed which is to be moved through a developing zone, a latent electrostatic image-forming means and a developing device for developing the latent electrostatic image formed on the member to be developed, the developing device including a movable frame member, a means for moving the movable frame member and a plurality of development mechanisms mounted on the movable frame member, each of the development mechanisms being adapted to be selectively positioned in the developing zone by moving the movable frame member, each of the development mechanisms having disposed therein a developer agitating means, and the development mechanisms respectively containing developers having toners of different colors; wherein the movable frame member of the developing device is provided with a driving source and a means for drivingly connecting the driving source to the agitating means of each of the development mechanisms, and the agitating means can be driven even during movement of the movable frame member.

The basis of the invention for achieving the second object is that an anchoring member is disposed in a stationary frame member in the developing device so that it is movable between an anchoring position and a non-anchoring position and a means is also provided for positioning the anchoring member selectively at the anchoring position and the non-anchoring position; a plurality of development mechanisms are disposed in a spaced-apart relationship in the moving direction of the movable frame member of the developing device and a plurality of anchor members are disposed in relation to the plurality of development mechanisms; and when one of the anchor members is contacted with the anchoring member held at the anchoring position by moving the movable frame member in a predetermined direction, a particular development mechanism relating to the anchor member in contact with the anchoring member is positioned in a developing zone.

The second object is thus achieved by a color image-forming machine comprising a member to be developed which is to be moved through a developing zone, a means for forming a latent electrostatic image on the member to be developed, and a developing device for developing the latent electrostatic image formed on the member to be developed, said developing device including a stationary frame member, a movable frame member movably mounted on the stationary frame member, a means for moving the movable frame member and a plurality of development mechanisms mounted on the movable frame member, the development mechanisms respectively having developers containing toners of different colors, and each of the development mechanisms being adapted to be selectively positioned in the developing zone by moving the movable frame member; wherein an anchoring member adapted to be moved between an anchoring position and a non-anchoring position and a means for selectively positioning the anchoring member at the anchoring or the non-anchoring position are mounted on the stationary frame member, a plurality of anchor members are disposed on the movable frame member in relation to the development mechanisms respectively, the development mechanisms and the anchor members are mounted on the movable frame member in spaced-apart relationship in the moving direction of the movable frame member, and when one of the anchor members is contacted with the anchoring member held at the anchoring position by moving the movable frame member in a predetermined direction, a particular development mechanism relating to the anchor member in contact with the anchoring member is positioned in the developing zone.

The basis of the invention for achieving the third object is that each of the development mechanisms is mounted on the movable frame member of the developing device so that it is free to move between an operative position and a non-operative position, and when each said development mechanism is positioned in the developing zone and at the operative position by the movement of the movable frame member, it can effect development of the member to be developed (such as an electrostatic photosensitive member); and a means is provided for forcing the development mechanism positioned in the developing zone to be held at the operative position and when the development mechanism is moved from the developing zone and no longer undergoes the action of the forcing means, the development mechanism is held at the non-operative position.

Thus, the third object of the invention is achieved by a color image-forming machine comprising a member to be developed which is to be moved through a developing zone, a means for forming a latent electrostatic image on the member to be developed, and a developing device for developing the latent electrostatic image formed on the member to be developed, said developing device including a stationary frame member, a movable frame member movably mounted on the stationary frame member, a means for moving the movable frame member and a plurality of development mechanisms mounted on the movable frame member, the development mechanisms having developers containing toners of different colors, and each of the development mechanisms being adapted to be selectively positioned in the developing zone by moving the movable frame member; wherein each of the development mechanisms is mounted on the movable frame member of the developing device so that it is free to move between an operative position and a non-operative position, each said development mechanism is constructed such that when it is positioned in the developing zone and at the operative position by the movement of the movable frame member, it can effect development of the member to be developed, a means is provided for forcing the development mechanism positioned in the developing zone to the operative position, and when the development mechanism is moved from the developing zone and no longer undergoes the action of the forcing means, it is held at the non-operative position.

The basis of the invention for achieving the fourth object is that after a specific developing device positioned in the developing zone begins to move from the developing zone, but before the next development mechanism is positioned in the developing zone, an electrostatic photosensitive member is additionally moved a predetermined distance, to move that part of the electrostatic photosensitive member, which existed in the developing zone at the beginning of movement of the specific development mechanism from the developing zone, downstream of the developing zone.

Thus, the fourth object is achieved by a color image-forming machine comprising an electrostatic photosensitive member to be moved along an endless moving passage successively passing through a latent electrostatic image forming zone, a developing zone, a transfer zone and a cleaning zone, a means for forming a latent electrostatic image on the electrostatic photosensitive member in the latent electrostatic image forming zone, a developing device for developing the latent electrostatic image on the electrostatic photosensitive member to a toner image in the developing zone, said developing device including a plurality of development mechanisms to be selectively positioned in the developing zone and the development mechanisms being loaded with developers containing toners of different colors, a transfer means for transferring the toner image on the photosensitive member to an image receiving member in the transfer zone, a cleaning means for removing the residual toner from the photosensitive member in the cleaning zone, and a control means, said control means being adapted to stop the movement of the photosensitive member before a specific development mechanism positioned in the developing zone begins to move from the developing zone, and to start the movement of the photosensitive member after the next development mechanism is positioned in the developing zone; wherein the control means further moves the photosensitive member additionally over a predetermined distance after a specific development mechanism positioned in the developing zone, begins to move from the developing zone but before the next development mechanism is positioned in the developing zone, whereby that part of the electrostatic photosensitive member which existed in the developing zone at the beginning of movement of the specific development mechanism from the developing zone is moved downstream of the developing zone.

DETAILED DESCRIPTION OF THE PREFERRED EMBODIMENTS

The preferred embodiments of the color image-forming machine of this invention will be described in detail with reference to the accompanying drawings.

Figure 1:
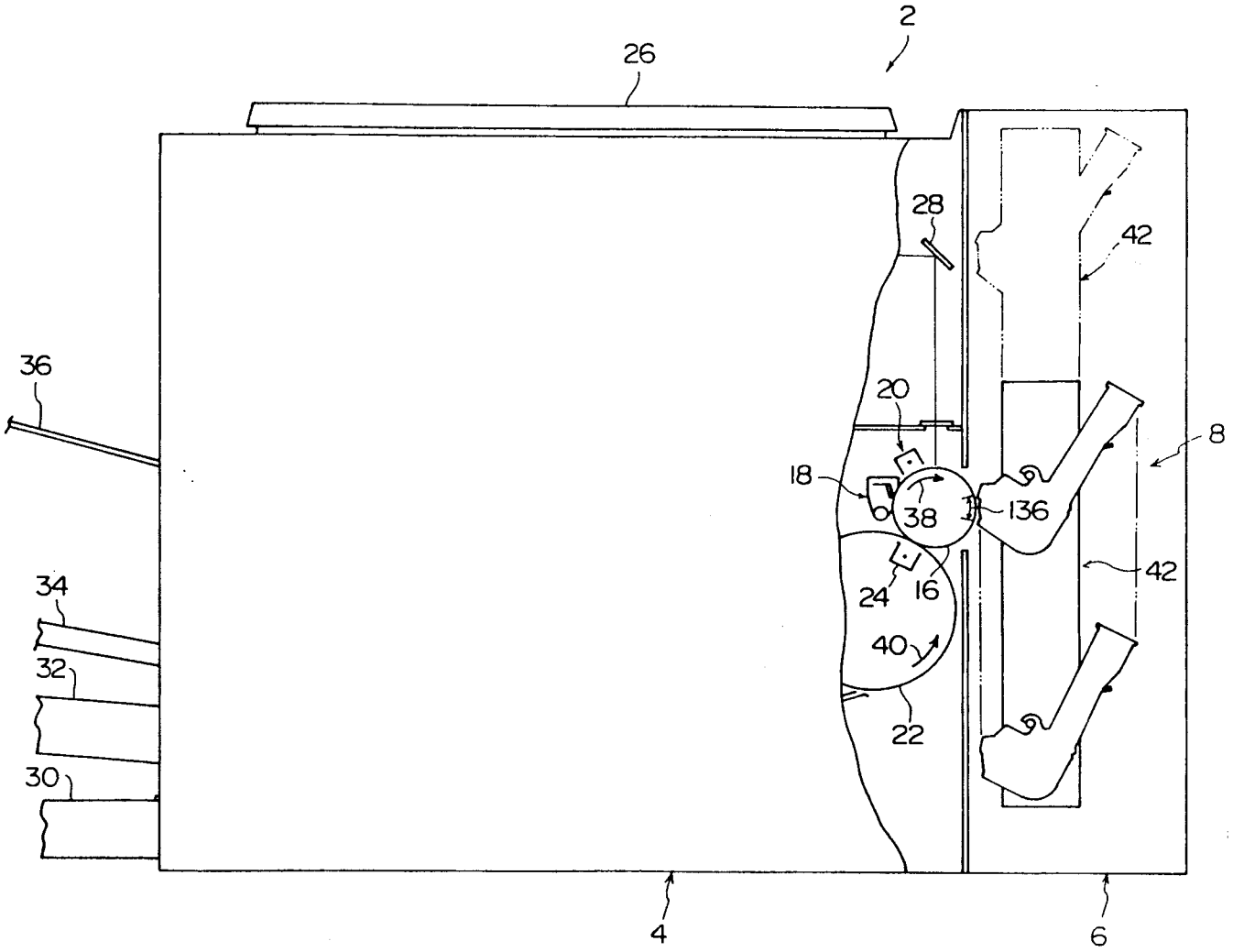
FIG. 1 is a simplified sectional view showing one specific embodiment of the color image-forming machine of the invention.
Figure 3:
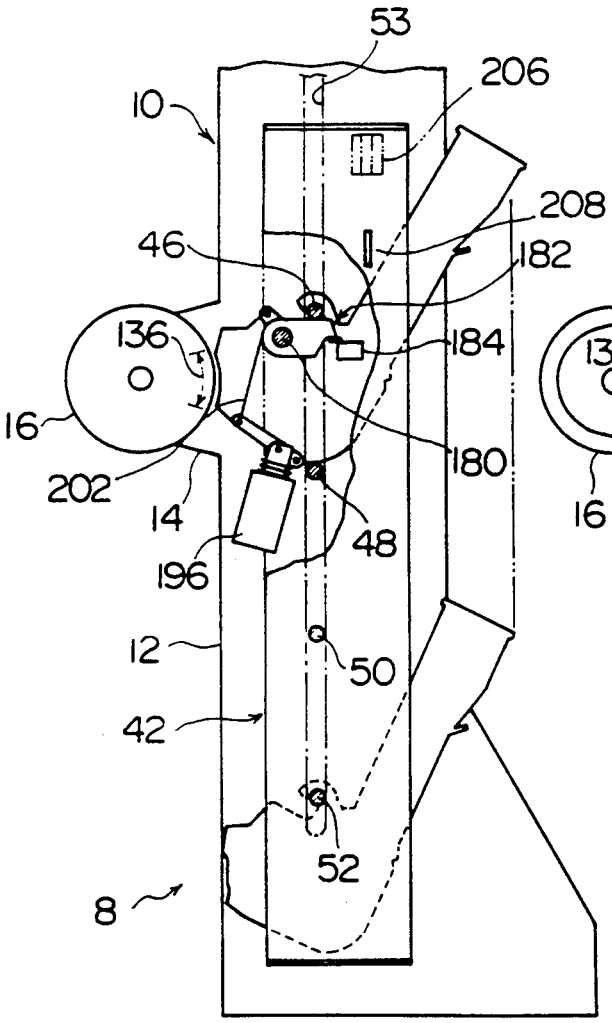
FIG. 3 is a partial side elevation, partly broken away, of the developing device in the color image-forming machine shown in FIG. 1.
Figure 2:
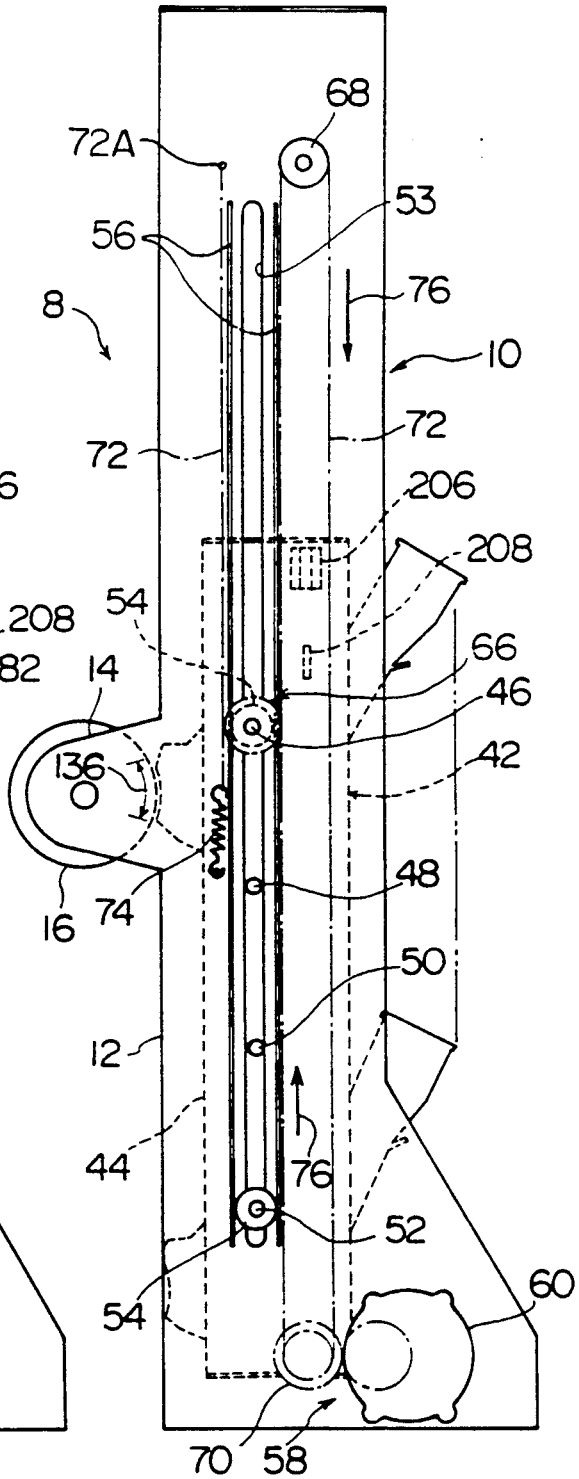
FIG. 2 is a side elevation showing a developing device in the color image-forming machine shown in FIG. 1.

With reference to FIG. 1, the color image-forming machine shown generally at 2 includes a nearly parallelpipedal main housing 4 and a subsidiary housing 6 annexed to the right side of the main housing 4. A developing device 8 is provided within the subsidiary housing 6. As shown in FIGS. 2 and 3, the developing device 8 includes a stationary frame member 10 disposed within the subsidiary housing 6 and having a front and a rear upstanding supporting base plate 12 spaced from each other in the front-rear direction (the direction perpendicular to the sheet surface in FIGS. 1 and 2). A supporting flange 14 projecting to the left is formed in a vertically intermediate part of each of the front and rear supporting base plates 12, and a rotating drum 16 is rotatably mounted on the supporting flanges 14. It is seen from FIG. 1 that the rotating drum projects into the main housing 4 and its major portion is positioned within the main housing 4. An electrostatic photosensitive member is disposed on the peripheral surface of the rotating drum 16. Within the main housing 4 are disposed a cleaning device 18 and a charging corona discharger 20 arranged around the rotating drum 16. A transfer rotating drum 22 is disposed adjacent to the rotating drum, and a transfer corona discharger 24 is provided at a predetermined site in the rotating drum 22. A transparent plate (not shown) on which to place a document to be copied, and an openable-closable document cover 26 for covering the document placed on the transparent plate are disposed on the upper surface of the main housing 4. An optical device for separating the image of the document placed on the transparent plate into four required colors, i.e. a yellow color, a red color (magenta), a blue color (cyan) and a black color, and projecting the image onto the photosensitive member on the rotating drum 16 for each of the colors separated (FIG. 1 shows only a reflecting mirror 28 as an optical element in one optical device) is disposed within an upper space in the main housing 4. Box-like cassettes 30, 32 and 34 holding image-receiving members which may be sheets of plain paper of a predetermined size are mounted to the left side portion of the main housing 4. A receiving tray 36 into which the image receiving member having a color image formed on its surface is discharged is also mounted to the left side portion of the main housing 4.

In the color image-forming machine 2 described above, the rotating drum 16 is rotated in the direction shown by an arrow 38 (the rotation of the rotating drum 16 will be further described hereinafter). While the rotating drum 16 is rotated, the electrostatic photosensitive member on the rotating drum 16 is charged to a predetermined polarity by the action of the charging corona discharger 20. The image of a document placed on the transparent plate is projected onto the photosensitive member on the rotating drum in any one of the required four colors subjected to color separation. As a result, a latent electrostatic image corresponding to the image of the document in any of these required colors is formed on the photosensitive member. As will be described in detail later, the developing device 8 includes four development mechanisms corresponding to the required colors, and the latent electrostatic image on the photosensitive member is developed to a toner image of any one of the required colors by any one of the four development mechanisms (accordingly, the electrostatic photosensitive member constitutes a member to be developed or developable member). On the other hand, the image receiving member fed from the cassette 30, 32 or 34 is wrapped around the peripheral surface of the transfer rotating drum 22 to be rotated in the direction shown by an arrow 40. The toner image on the photosensitive member is transferred to an image receiving member on the transfer rotating drum 22 by the action of the transfer corona discharger 24 constituting transfer means. After the transfer, the cleaning device acts on the photosensitive member of the rotating drum 16, and removes the toner remaining on it. This image forming process is performed successively for all of the required four colors. As a result, a color image corresponding to the image of the document is formed on the image receiving member. Then, the image receiving member bearing the color image on its surface is peeled off from the transfer rotating drum 22, conveyed through a fixing device (not shown) and other required devices, and discharged into the receiving tray.

It should be understood that various structures and operations of the color image-forming device 2 of this invention except those of the developing device 8 to be described below do not constitute the novel improved features of this invention, and may be those known to one skilled in the art. Therefore, a detailed description of the structures and operations of the color image forming machine will be omitted herein.

Figure 4:
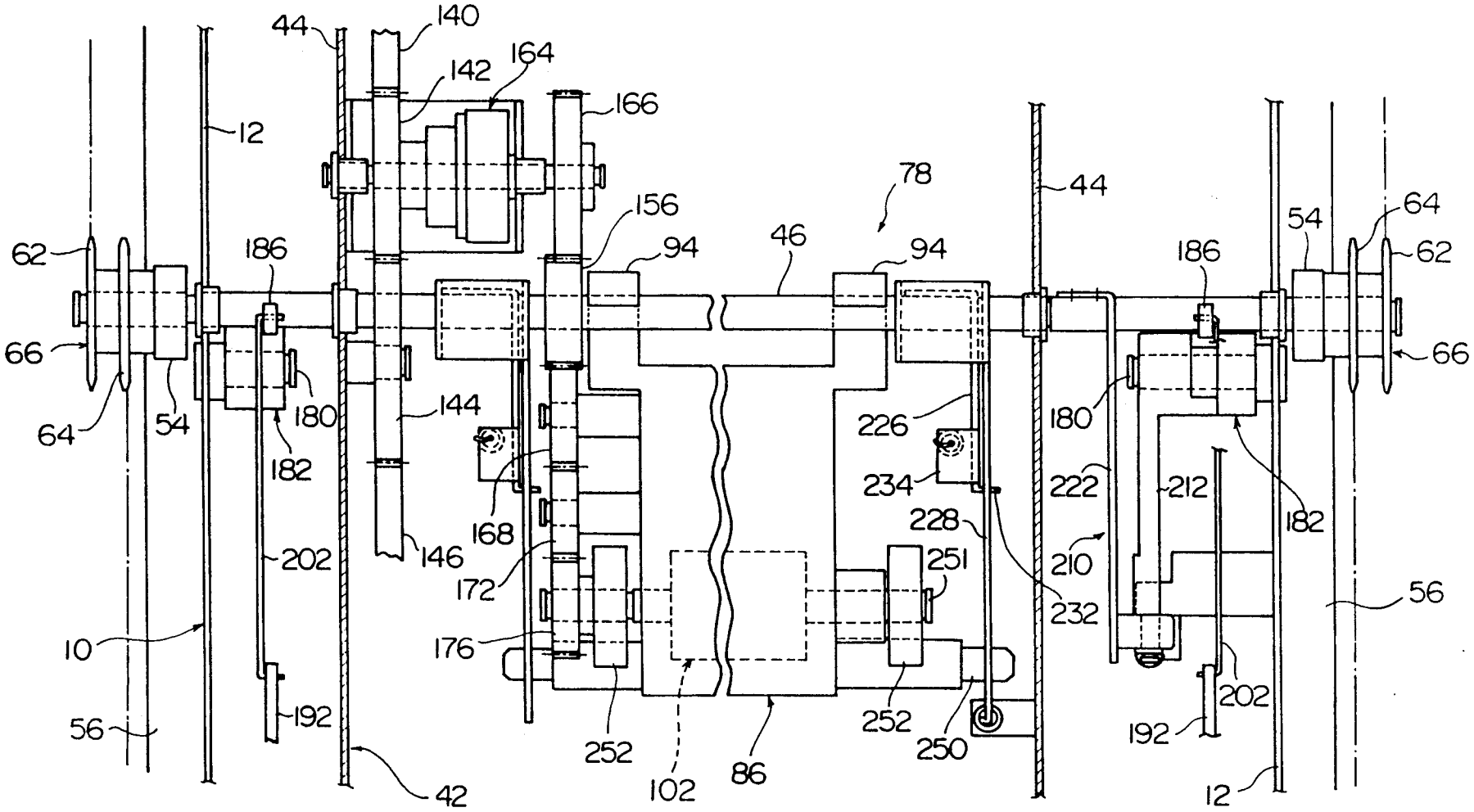
FIG. 4 is a sectional view showing part of the developing device in the color image-forming machine shown in FIG. 1.
Figure 5:
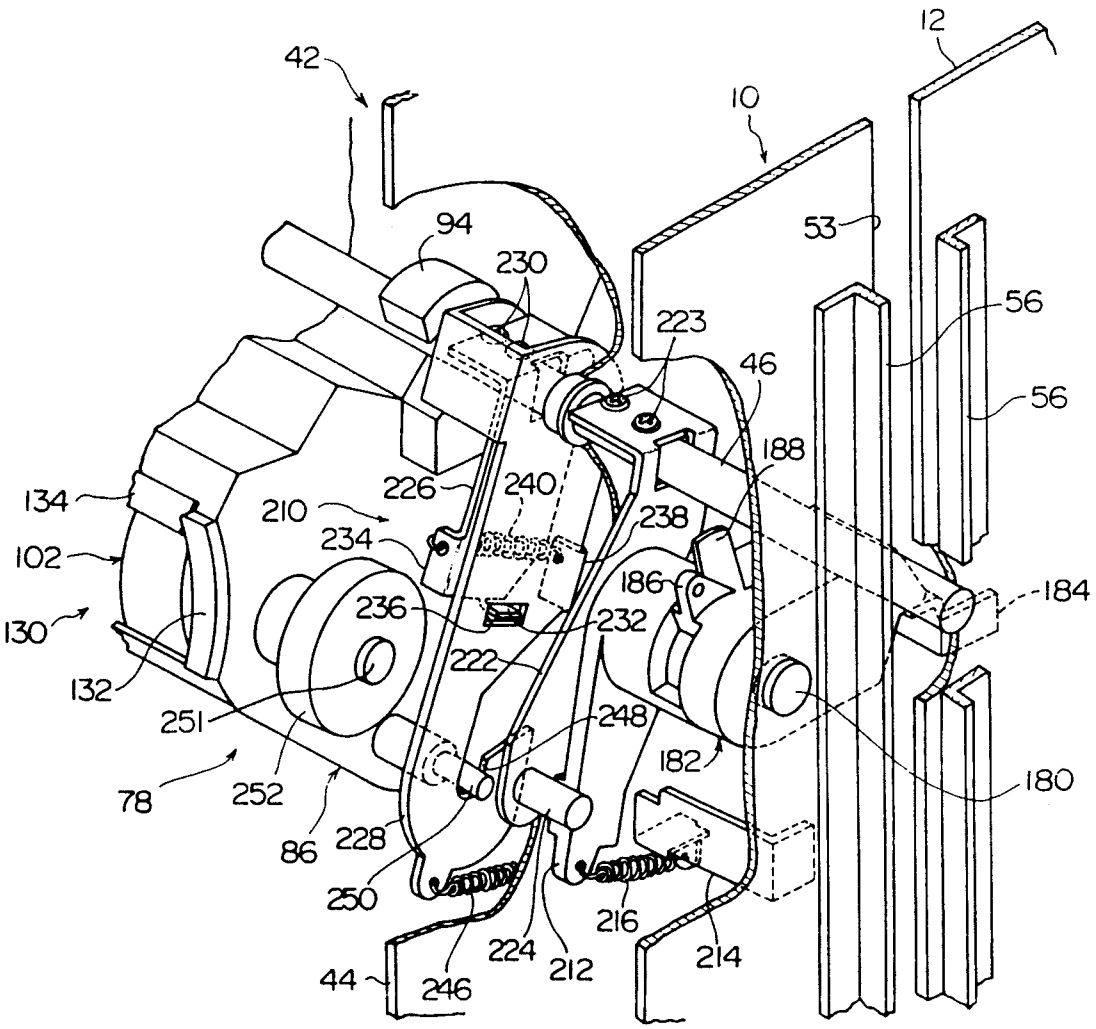
FIG. 5 is a partial perspective view, partly broken away, of part of the developing device in the color image-forming machine shown in FIG. 1.

Again, with reference to FIGS. 2 and 3, the illustrated developing device 8 includes the stationary frame member 10 disposed in the subsidiary housing 6 (FIG. 1) and a movable frame member 42 mounted on the stationary frame member in such a manner that it is free to ascend and descend in a substantially vertical direction. With reference to FIGS. 4 and 5 in conjunction with FIGS. 2 and 3, the movable frame member 42 has front and rear upstanding supporting plates 44 spaced from each other in the front-rear direction (the direction perpendicular to the sheet surface in FIGS. 2 and 3 and the left-right direction in FIG. 4). Four supporting shafts 46, 48, 50 and 52 extending substantially horizontally and spaced equidistantly in the vertical direction are mounted rotatably across the upstanding supporting plate 44 (these supporting shafts 46, 48, 50 and 52 also function as anchor members for positioning the movable frame member 42 at a predetermined position). Both end portions of each of the supporting shafts 46, 48, 50 and 52 project via a substantially vertically extending channel 53 formed in the front and rear upstanding supporting base plates 12 of the stationary frame member 10. Guided rollers 54 are rotatably mounted respectively on both end portions of the uppermost supporting shaft 46 and both end portions of the lowermost supporting shaft 52. As clearly shown in FIGS. 2 and 5, a pair of substantially vertically extending guide rails 56, spaced laterally at a predetermined distance, are fixed to the outside surfaces of the upstanding base plates 12 of the stationary frame member 10. The lateral distance between the pair of guide rails 56 corresponds to the diameter of the guided roller 54. By positioning the guided roller 54 between the pair of guide rails 56, the movable frame member 42 is mounted on the stationary frame member 10 such that it is free to ascend and descend in a substantially vertical direction. A movable frame member moving means 58 is also disposed in the stationary frame member 10 for elevating or lowering the movable frame member 42. The movable frame member moving means 58 in the illustrated embodiment is comprised of a wrapping transmission mechanism having a rotating driving source 60 (FIG. 2) which may be an electric motor. As shown clearly in FIG. 4, two sprocket wheels 62 and 64 are rotatably mounted on each of both end portions of the uppermost supporting shaft 46. On the other hand, as shown in FIG. 2, an upper sprocket wheel 68 and a lower sprocket wheel 70 are rotatably mounted on each of the front and rear upstanding supporting base plates 12 of the stationary frame member 10. The output shaft of the rotating driving source 60 is drivingly connected to the lower sprocket wheel 70 via a transmission means such as a gear. In both the front and rear of the movable frame member 42, a chain 72 is wrapped around the sprocket wheels 62, 64, 68 and 70 in the following manner. As shown in FIG. 2, one end 72A of the chain 72 is fixed to the upstanding supporting base plate 12 of the stationary frame member 10. The chain 72 extends downwardly from this end, is wrapped about the sprocket wheel 62, then extends upwardly and is wrapped about the sprocket wheel 68, further extends downwardly and is wrapped about the sprocket wheel 70. It further extends upwardly and is wrapped about the sprocket wheel 64, and thereafter, extends downwardly and is fixed via a tension spring 74 to the upstanding supporting base plate 12 of the stationary frame member 10. Thus, when the driving source 60 is energized and the chain 72 is revolved in the direction shown by an arrow 76, the movable frame member 42 is elevated or lowered (elevation or lowering of the movable frame member 42 will be described further in detail hereinafter).

Figure 6:
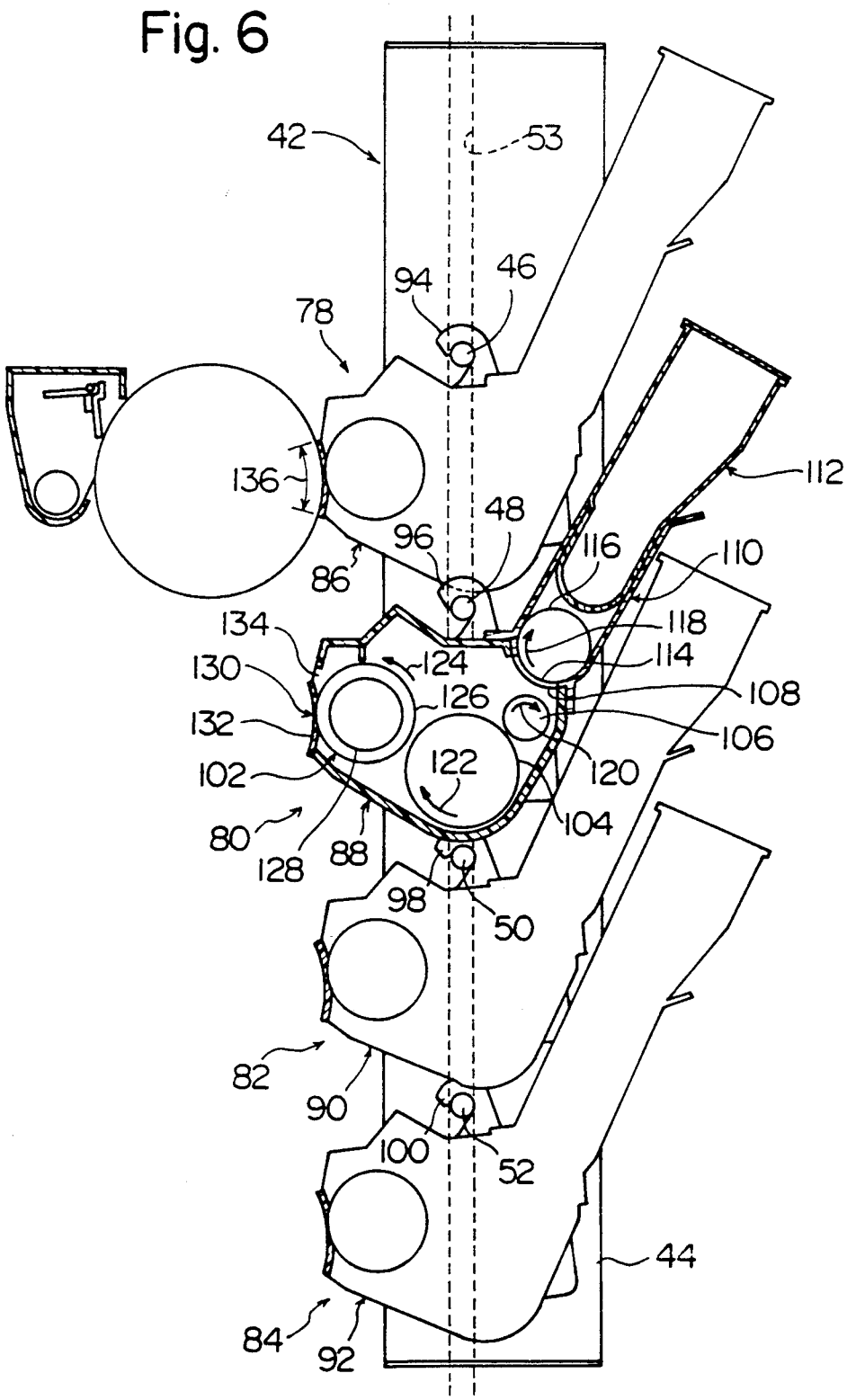
FIG. 6 is a simplified partial sectional view showing the developing device in the color image-forming machine shown in FIG. 1.

With reference to FIG. 6 taken in conjunction with FIGS. 4 and 5, the movable frame member 42 has rotatably mounted thereon the four substantially horizontally extending supporting shafts 46, 48, 50 and 52 described above at equal intervals in a vertical direction. Development mechanisms 78, 80, 82 and 84 are mounted respectively on the supporting shafts 46, 48, 50 and 52. These development mechanisms 78, 80, 82 and 84 respectively have development housings 86, 88, 90 and 92. A pair of hook-like portions 94, 96, 98 and 100, spaced respective in the front-rear direction, are integrally formed on the upper surfaces of these development housings 86, 88, 90 and 92, and by suspending these hook-like portions 94, 96, 98 and 100 pivotably from the supporting shafts 46, 48, 50 and 52, the development mechanisms 78, 80, 82 and 84 are pivotably mounted respectively on the supporting shafts 46, 48, 50 and 52. As will be stated hereinafter, the development mechanisms 78, 80, 82 and 84 are selectively positioned at an acting position and an action-undergoing position by pivoting them respectively about the supporting shafts 46, 48, 50 and (52 as a center). As shown in FIG. 6 with respect to the development mechanism 80, a developer applicator means 102, a first agitating means 104 and a second agitating means 106 are disposed in each of the development housings 86, 88, 90 and 92. An opening 108 is formed in the upper surface of the right end portion of each of these development housings 86, 88, 90 and 92, and a toner supplier 110 is fixed to the development housings 86, 88, 90 and 92 by causing its lower end portion to advance into the opening 108. The upper surface of the toner supplier 110 is left open, and a toner cartridge 112 is loaded into the toner supplier 110 through the open upper surface of the toner supplier 110. The lower end surface of the toner cartridge 112, which may be of a known type, is opened by peeling a sealing member applied to it. A toner is supplied to the toner supplier 110 from the toner cartridge 112 through its open lower end surface. A discharge opening 114 is formed in the lower end surface of the toner supplier 110, and a supply roller 116 is rotatably mounted in relation to the discharge opening 114. When the supply roller 116 is rotated, in the direction shown by arrow 118, by a driving source (not shown) which may be an electric motor provided in the toner supplier 110, a toner is supplied to the development housings 86, 88, 90 and 92 from the toner supplier 110 through the discharge opening 114. The toner supplied in the development housing 96, 88, 90 or 92 is mixed with the developer present in the development housing 86, 88, 90 or 92 by the action of the second agitating means 106 rotating in the direction shown by arrow 120. The first agitating means 104 is rotated in the direction shown by an arrow 122 and agitates the developer. The developer present in the development housing 86, 88, 90 or 92 contains a carrier together with the toner, and by the agitating action of the first agitating means 104, the toner is triboelectrically charged. The developer applicator means 102 is comprised of a sleeve 126 to be rotated in the direction shown by arrow 124 and a stationary magnet 128 disposed in the sleeve 126. The developer applicator means 102 holds the developer on the sleeve 126 by the magnetic attracting force of the roll-like magnet, and applies the developer to an electrostatic photosensitive member (member to be developed) having a latent electrostatic image to be developed to thereby develop it to a toner image (the development will be further described hereinafter). A development opening 130 for enabling the developer applicator means 102 to act on the electrostatic photosensitive member is formed in the left side surface of each of the development housings 86, 88, 90 and 92. As clearly shown in FIG. 5, a flexible member 132 which may be a felt material having a thickness of about 2 to 3 mm is disposed in the front edge portion and rear edge portion of the development opening 130. A flexible member 134 which may be a synthetic resin film having a thickness of about 0.1 to 0.2 mm is disposed in the upper edge portion of the development opening 130. When each of the development housings 86, 88, 90 and 92 is positioned in a developing zone 136 opposite to the rotating drum 16 as described hereinbelow, the flexible members 132 and 134 make contact with the surface of the rotating drum 16 and prevent scattering of the toner from the development opening 130 during the development. In the developing device 8, four development mechanisms 78, 80, 82 and 84 are provided, and developers containing toners of different colors are filled in the four development mechanisms 78, 80, 82 and 84. The development housing 86 of the uppermost development mechanism 78 has filled therein a developer containing a carrier and a yellow toner. The development housing 88 of the second development mechanism 80 from top has filled therein a developer containing a carrier and a red (magenta) toner. The development housing 90 of the third development mechanism 82 from top has filled therein a developer containing a carrier and a blue (cyan) toner. The development housing 92 of the lowermost development mechanism 84 has filled therein a developer containing a carrier and a black toner.

The developer applicator means 102, the first agitating means 104 and the second agitating means 106, disposed in each of the four development mechanisms 78, 80, 82 and 84 in the illustrated developing device 8, must be properly rotated. In the illustrated embodiment in accordance with this invention, a rotating driving source and a drive coupling means for rotating the developer applicator means 102, the first agitating means 104 and the second agitating means 106 are disposed in the movable frame member 42.

Figure 7:
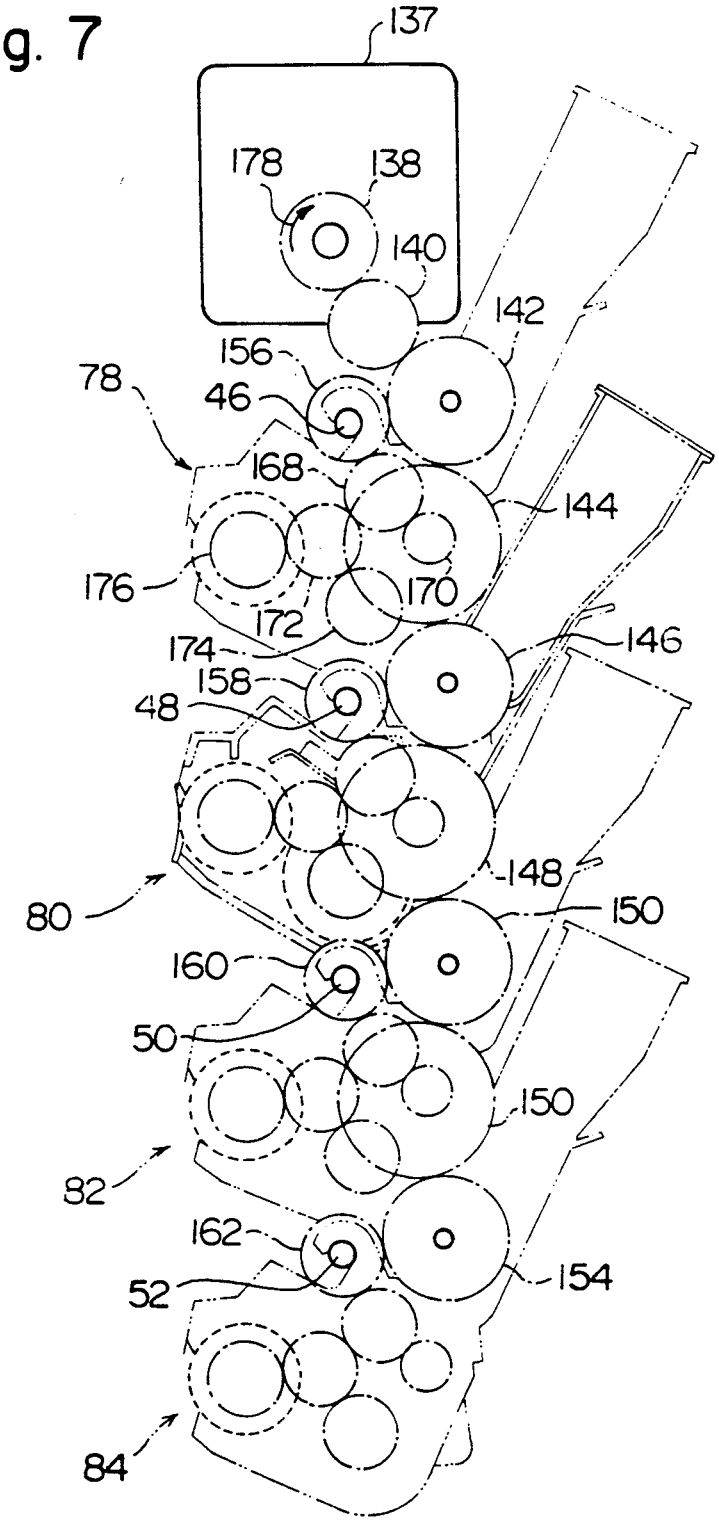
FIG. 7 is a simplified cross sectional view showing the developing device in the color image-forming machine shown in FIG. 1.

With reference to FIGS. 7 and 4, a rotation driving source 137, which may be an electric motor, is mounted on the upper portion of the rear upstanding supporting plate 44 of the movable frame member 42. To the output shaft 137 of this driving source is fixed a gear 138. Furthermore, transmission gears 140, 142, 144, 146, 148, 150, 152 and 154 are rotatably mounted on the rear upstanding supporting plate 44 of the movable frame member 42. On the other hand, input gears 156, 158, 160 and 162 are rotatably mounted respectively on the supporting shafts 46, 48, 50 and 52 on which the development housings 86, 88, 90 and 92 are respectively mounted pivotably. It will be understood by reference to FIG. 4 that a control clutch 164 and a gear 166 are mounted on the movable frame member 42 in relation to each of the transmission gears 142, 146, 150 and 154 (FIG. 4 shows only the control clutch 164 and the gear 166 disposed in relation to the input gear 156 of the development mechanism 78). The transmission gears 142, 146, 150 and 154 are linked respectively to the input gears 156, 158, 160 and 162 via the control clutch 164 and the gear 166. In each of the development mechanisms 78, 80, 82 and 84, transmission gears 168, 170, 172, 174 and 176 are mounted respectively on the development housings 86, 88, 90 and 92. The gear 168 is in mesh with each of the input gears 156, 158, 160 and 162, and the gears 170 and 172 are also in mesh with the gear 168. The gears 174 and 176 are in mesh with the gear 172. The gear 170 is connected to the second agitating means 106, and the gear 174, to the first agitating means 104. The gear 176 is connected to the sleeve 126 of the developer applicator means 102. Thus, when the output shaft of the rotating driving source 137 is rotated in the direction shown by an arrow 178 by energizing the rotating drive source 137 and the control clutch 164 relating to the development mechanism 78 and is connected, the sleeve 126 of the developer applicator means 102, the first agitating means 104 and the second agitating means 106 in the development mechanism 78 are rotated in the directions shown by arrows 124, 122 and 120 respectively. When the control clutch 164 relating to the development mechanism 80 is connected, the sleeve 126 of the developer applicator means 102, the first agitating means 104 and the second agitating means 106 in the development mechanism 80 are rotated in the directions shown by arrows 124, 122 and 120. When the control clutch 164 relating to the development mechanism 82 is connected, the sleeve 126 of the developer applicator means 102, the first agitating means 104 and the second agitating means 106 in the development mechanism 82 are rotated in the directions shown by arrows 124, 122 and 120. When the control clutch 164 relating to the development mechanism 84 is connected, the sleeve 126 of the developer applicator means 102, the first agitating means 104 and the second agitating means 106 in the development mechanism 84 are rotated in the directions of arrows 124, 122 and 120.

As will be further stated hereinbelow, the development housings 86, 88, 90 and 92 are pivotably mounted respectively on the supporting shafts 46, 48, 50 and 52, and adapted to be pivoted about the supporting shafts 46, 48, 50 and 52, respectively, as a center. Since, as stated above, the input gears 156, 158, 160 and 162 are rotatably mounted on the supporting shafts 46, 48, 50 and 52 constituting the central axes of pivoting of the development housings 86, 88, 90 and 92, the drive connecting relations described above are maintained unimpaired even when the development housings 86, 88, 90 and 92 are pivoted.

In the illustrated embodiment of the invention, the rotation driving source 137 for rotating the developer applicator means 102, the first agitating means 104 and the second agitating means 106 in the development mechanisms 78, 80, 82 and 84 and various drive-connecting elements relating thereto are mounted on the movable frame member 42. According by utilizing the time during which the movable frame member 42 is moved in order to use the next development mechanism in place of the specific development mechanism in use, the developer can be agitated ("aged") by rotating the first agitating means 104 and the second agitating means 106 in the next development mechanism. Because of the "aging" of the developer, the time required for the image-forming process can be prevented from increasing.

Figure 8:
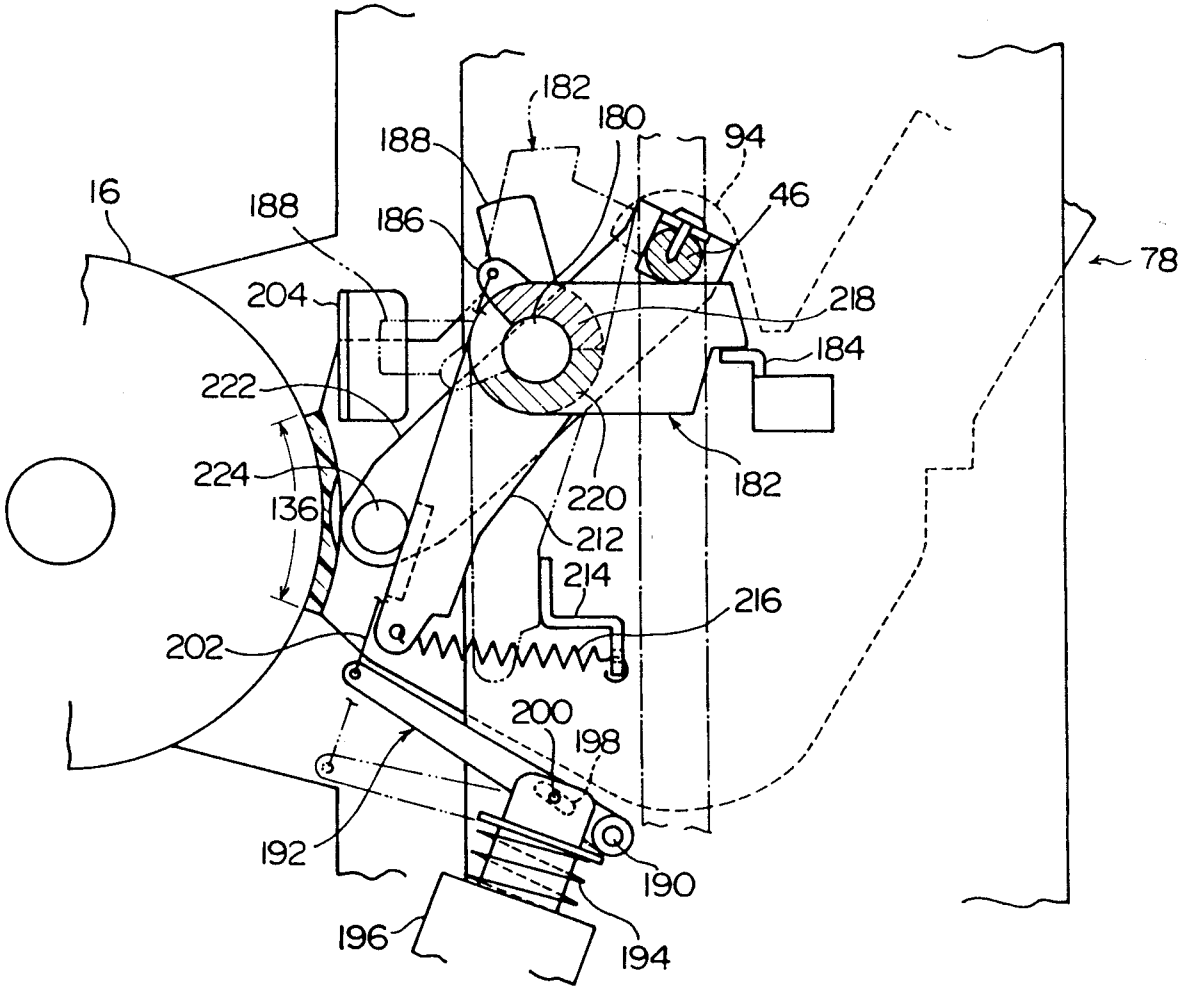
FIG. 8 is a sectional view showing part of the developing device in the color image-forming machine shown in FIG. 1.

It is important that in the illustrated embodiment of the invention, the four development mechanisms 78, 80, 82 and 84 in the developing device 8 should be positioned precisely in the developing zone 136 in succession (in FIGS. 1 to 3, the uppermost development mechanism 78 is positioned in the developing zone 136 opposite to the rotating drum 16). With reference to FIGS. 3, 4, 5 and 8, a structure relating to the positioning of the development mechanisms 78 to 84 will be described. A short rod 180 extending inwardly substantially horizontally is fixed to the upstanding supporting base plate 12 of the stationary frame member 10. On the short rod 180 is mounted an anchoring member 182 such that it is free to pivot between an anchoring position shown in FIGS. 3 and 5 and by a solid line in FIG. 8 and a non-anchoring position shown by a two-dot chain line in FIG. 8. A restraining member 184 is also fixed to the upstanding supporting base plate 12 of the stationary frame member 10. When the anchoring member 182 is held at the anchoring position, a contact portion formed in the free end of the anchoring member 182 makes contact with the restraining member 184 whereby pivoting of the anchoring member 182 further clockwise in FIG. 8 beyond the anchoring position is hampered. A protruding portion 186 and a detection piece 188 are integrally formed in the base portion of the anchoring member 182. As shown in FIGS. 3 and 8, a lever 192 is pivotably mounted on the upstanding supporting base plate 12 of the stationary frame member 10 by means of a pin 190, and an electromagnetic solenoid 196 including a compression spring 194 built therein is also mounted on it. As will be clear from the description given later on, the electromagnetic solenoid 196 including the compression spring 194 built therein constitutes an anchoring member positioning means for selectively holding the anchoring member 182 at the anchoring position and the non-anchoring position. The compression spring 194 itself constitutes an elastic biasing means for elastically biasing the anchoring member 182 at the anchoring position. The electromagnetic solenoid constitutes an anchor releasing means for pivoting the anchoring member 182 from the anchoring position to the non-anchoring position. A slender slot 198 is formed in the lever 192, and by inserting a linking pin 200 fixed to the output rod of the electromagnetic solenoid 196 through the slot 198, the output rod of the electromagnetic solenoid 196 is connected pivotably relative to the lever 192 and movably along the slot 198. The free end of the lever 192 and the protruding portion 186 formed in the anchoring member 182 are connected to each other by a slender rod 202. A detector 204, which may be an optical detector having a light emitting element, and a light receiving element is also fixed to the upstanding supporting base plate 12 of the stationary frame member 10. When the anchoring member 182 is held at the non-anchoring position shown by the two-dot chain line in FIG. 8, the detector 204 detects the detection piece 188 formed in the anchoring member 182.

In the state shown in FIGS. 3 and 5 and by a solid line in FIG. 8, the electromagnetic solenoid 196 is in the deenergized state, and the anchoring member 182 is held at the anchoring position shown by the solid line in FIG. 8, and both end portions of the supporting shaft 46 from which the development housing 86 of the uppermost development mechanism 78 are suspended make contact with the upper surface of the anchoring member 182 at the anchoring position. As a result, the development mechanism 78 is precisely positioned in the developing zone 136. When in this state the movable frame member 42 is elevated by the movable frame member moving means 58 (FIG. 2), the supporting shaft 46 from which the development housing 86 of the development mechanism 78 positioned in the developing zone 36 is suspended moves away upwardly from the anchoring member 182, but both end portions of the supporting shaft 48 from which the development housing 88 of the development mechanism 80 below is suspended make contact with the anchoring member 182 from below. Accordingly, when the movable frame member 42 is further elevated, the anchoring member 182 is pivoted to the non-anchoring position shown by the two-dot chain line in FIG. 8 from the anchoring position shown by the solid line in FIG. 8 by the action of the supporting shaft 48. As a result, the detector 204 detects the detection piece 188 of the anchoring member 182. When the supporting shaft 48 passes the anchoring member 182 and fails to act on it, the anchoring member 182 returns to the anchoring position shown by the solid line in FIG. 8 by the action of the elastic biasing action of the compression spring 194 built in the electromagnetic solenoid 196 and the weight of the anchoring member 182. When at this time, the movable frame member moving means 58 (FIG. 2) is deenergized to permit the movable frame member 42 to descend by its own weight, both end portions of the supporting shaft 48 which has passed the anchoring member 182 make contact with the upper surface of the anchoring member 182 returned to the anchoring position, and in this state, the descending of the movable frame member 42 is stopped. Thus, the second development mechanism 80 from the top is positioned in the developing zone 136.

When the movable frame member 42 is elevated successively by a required amount and then allowed to descend by its own weight, the third development mechanism 82 from the top and the lowermost development mechanism 84 can successively be positioned in the developing zone 136.

Since the positioning of each of the developing mechanisms 78, 80, 82 and 84 is carried out by contacting each of the supporting shafts 46, 48, 50 and 52 with the anchoring member 182 existing at the anchoring position, each of the development mechanisms 78, 80, 82 and 84 can be positioned in the developing zone 136 stably and precisely only if the anchoring member 182 is held precisely at the anchoring position. After the lowermost development mechanism 84 is positioned in the developing zone 136, the movable frame member 42 is slightly elevated to move the supporting shaft 52 of the developing mechanism 84 upwardly from the anchoring member 182, and then the electromagnetic solenoid is energized. As a result, the anchoring member 182 is pivoted to the non-anchoring position shown by the two-dot chain line in FIG. 8 from the anchoring position shown by the solid line in FIG. 8. Then, the movable frame member moving means 58 (FIG. 2) is deenergized to permit the movable frame member 42 to descend. Thus, the movable frame member 42 descends by its own weight. The electromagnetic solenoid 196 is deenergized when the movable frame 42 descends until the supporting shaft 46 of the uppermost development mechanism 78 is located slightly above the anchoring member 182. As a result, the anchoring member 182 is returned to the anchoring position shown by the solid line in FIG. 8 by the elastic biasing action of the compression spring 194 and the own weight of the anchoring member 182. Thus, both end portions of the supporting shaft 46 of the uppermost developing mechanism 78 come into contact with the upper surface of the anchoring member 182 returned to the anchoring position, and the upper most development mechanism 78 is returned to the initial state in which it is positioned in the developing zone 136.

In order to create the initial state by lowering the movable frame member 42 as above, it is desirable to decrease the descending speed of the movable frame member 42 sufficiently in the last stage by producing a braking force when the movable frame member 42 has descended to a predetermined position. This can be performed, for example, by producing a driving force in a direction to elevate the movable frame member 42 in the driving source 60 of the movable frame member moving means 58 shown in FIG. 2. In the illustrated embodiment, the optical detector 206 having a light emitting element and a light receiving element is mounted on the stationary frame member 10 and the detect piece 208 is fixed to the movable frame member 42 as shown in FIGS. 2 and 3. When the movable frame member 42 descends to a predetermined position by a predetermined amount from the initial position (i.e., the state in which the uppermost development mechanism 78 is positioned in the developing zone 136), the detector 206 detects the detection piece 208. At this time, the electromagnetic solenoid 196 is deenergized and a braking force is produced in the driving source 60 of the movable frame member moving means 58.

Figure 9:
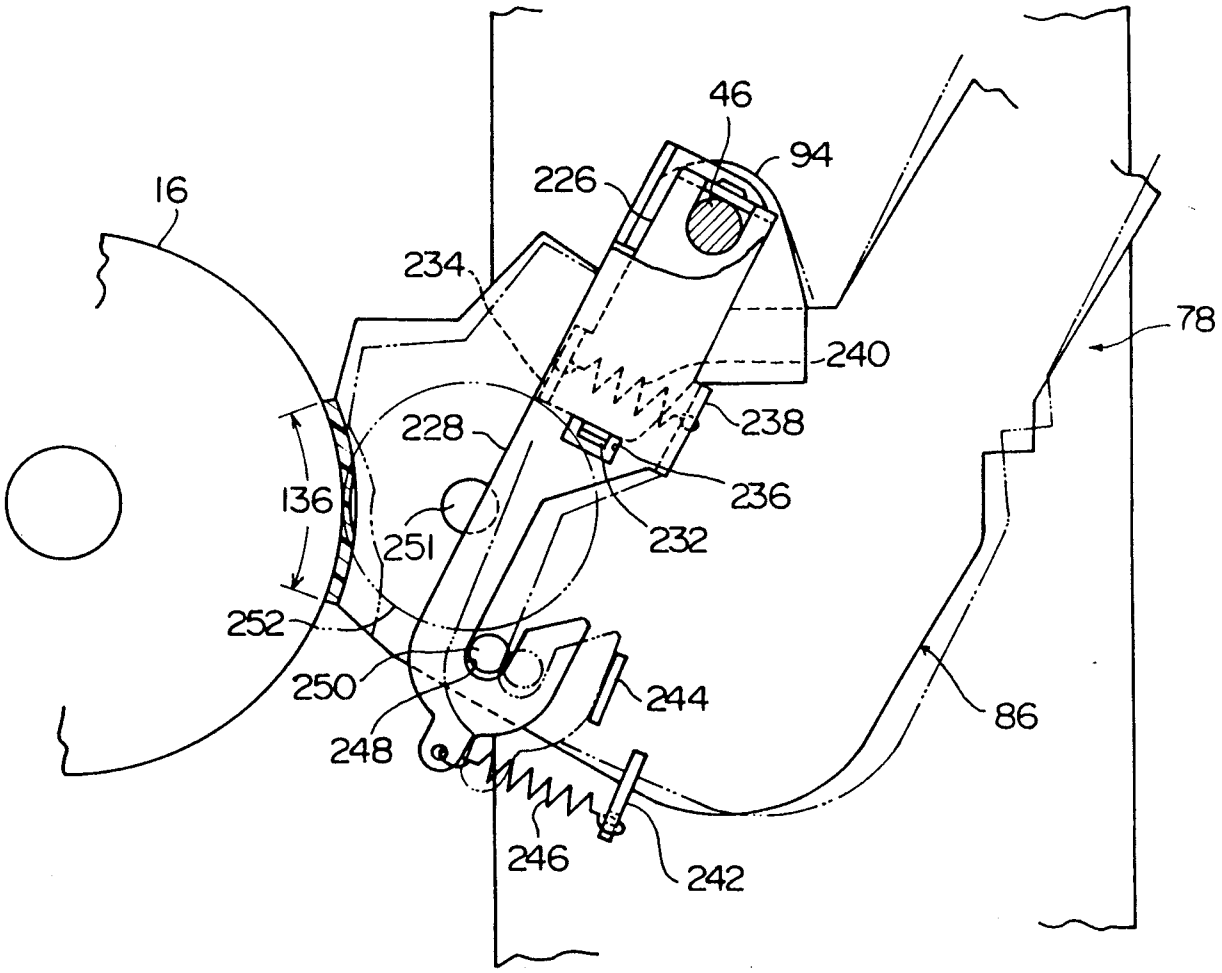
FIG. 9 is a sectional view showing part of the developing device in the color image-forming machine shown in FIG. 1.

In the illustrated embodiment of the invention, the development mechanism 78 to 84 in the developing device 8 are respectively mounted on the supporting shafts 46 to 50 to as to be free to pivot between an operative position and a non-operative position as stated hereinabove. Each of the development mechanisms 78 to 84 is constructed such that when it is positioned in the developing zone 136 as above, and at the same time held at the operative position, it is in condition for developing a latent electrostatic image on the electrostatic photosensitive member disposed on the peripheral surface of the rotating drum 16. In addition, in the illustrated embodiment, there is also disposed a forcing means 210 which, when each of these development mechanisms is positioned in the developing zone 136 as above, forces it to the operative position from the non-operative position. With reference to FIGS. 4, 5 and 8, a movable member 212 is also mounted pivotally on the short rod 180 fixed to the upstanding supporting base plate 12 of the stationary frame member 10. A bracket piece 214 is further fixed to the upstanding supporting base plate 12, and a relatively weak tension spring 216 is stretched between the bracket piece 214 and the front end portion of an extending arm portion of the movable member 212. The tension spring 218 elastically forces the movable member 212 counterclockwise in FIG. 8. The counterclockwise pivoting of the movable member 212 in FIG. 8 is restricted as a result of contacting of the extending arm portion of the movable member 212 with the bracket piece 214, as shown by two-dot chain line in FIG. 8. It will be understood from FIG. 5 as well as FIG. 8 that an arcuate protrusion 218 protruding toward the movable member 212 is formed in the hub portion of the anchoring member 182, mounted on the short rod 180, and in correspondence to it, an arcuate protrusion 220 protruding toward the anchoring portion 182 is formed in the hub portion of the movable member 212. When the anchoring member 182 is pivoted from the non-anchoring position shown by the two-dot chain line in FIG. 8 to the anchoring position shown by the solid line in FIG. 8, the arcuate protrusion 218 of the anchoring member 182 comes into contact with the arcuate protrusion 220 of the movable member 212, and causes the movable member 212 to pivot to a forcing position shown by a solid line in FIG. 8 from a non-forcing position shown by a two-dot chain line in FIG. 8 against the elastic biasing action of the tension spring 216. In other words, when the anchoring member 182 is held at the anchoring position, the movable member 212 is held at the forcing position, and when the anchoring member 182 is at the non-anchoring position, the movable member 212 is held at the non-forcing position. With reference to FIGS. 9 as well as FIGS. 8 and 5, a first arm portion 222 is fixed to each of the supporting shafts 46 to 52 of the development mechanisms 78 to 84 (FIGS. 5, 8 and 9 only show the development mechanism 78 and its supporting shaft 46). The first arm member 222 extends nearly downwardly from its base portion fixed to the supporting shaft 46, 48, 50 or 52 by means of a setscrew 223, and a forwardly extending pin 224 is implanted in its free end portion. A second arm member 226 is also fixed to each of the supporting shafts 46, 48, 50 and 52, and a pivot member 228 is also pivotally mounted on the supporting shaft. The second arm member 226 extends nearly downwardly from its base portion fixed to the supporting shaft 46, 48, 50 or 52 by means of a setscrew 230, and a protrusion 232 projecting forwardly from its central part and a protrusion 234 projecting rearwardly from its left side portion are formed in its free end portion. The pivot member 228 extends nearly downwardly from its base portion pivotally mounted on the supporting shaft 46, 48, 50 or 52. A rectangular opening 236 is formed in the intermediate part in the extending direction of the pivot member 228. The protrusion 232 formed in the second arm member 226 is inserted into this opening 236. A protrusion 238 projecting rearwardly from the right side portion is formed in the intermediate part in the extending direction of the pivot member 228. A relatively strong tension spring 240 is stretched taut between the protrusion 238 and the protrusion 234 formed in the second arm member 226. As shown in FIG. 9, a bracket piece 242 and a stop piece 244 are fixed to the movable frame member 42 in relation to the pivot member 228 of each of the development mechanisms 46 to 52. A tension spring 246 is stretched taut between the free end portion of the pivot member 228 and the bracket piece 242. The tension spring 246 elastically biases the pivot member 228 counterclockwise in FIG. 9. The pivoting of the pivot member 228 in the counterclockwise direction in FIG. 9 is restricted by the contacting of the right side edge of the free end portion of the pivot member 228 with the stop piece 244 as shown by a two-dot chain line in FIG. 9. An anchoring channel 248 is also formed in the free end portion of the pivot member 228. On the other hand, an anchoring pin 250 projecting forwardly is implanted in the lower part of the front wall of each of the development housings 86 to 92 of the development mechanisms 46 to 52. The anchoring pin 250 is inserted through the anchoring channel 248. Furthermore, as shown in FIGS. 5 and 9, the developer applicator means 102 disposed in each of the development housings 86 to 92 is mounted on a supporting shaft member 251. Both end portions of the supporting shaft member 251 project beyond the front and rear wall of each of the development housings 86 and 92, and positioning discs 252 are rotatably mounted on these projecting ends of the supporting shaft member 251 (FIGS. 5 and 9 only show the positioning disc 252 on the front side).

With reference to FIGS. 5, 8 and 9, when the anchoring member 182 is held at the anchoring position shown by the solid line in FIG. 8 and the supporting shaft 46 (48, 50 or 52) of the development mechanism 78 (80, 82 or 84) comes into contact with the upper surface of the anchoring member 182 to position the development mechanism 78 (80, 82 or 84) in the developing zone 136, the arcuate protrusion 218 of the anchoring member 182 acts on the arcuate protrusion 220 of the movable member 212, and the movable member 212 is held at the forcing position shown by the solid line in FIG. 8. As a result, the movable member 212 acts on the pin 224 of the first arm member 222 to pivot the first arm member 222 clockwise as viewed from right bottom in FIG. 5. Since the first arm member 222 is fixed to the supporting shaft 46 (49, 50 or 52), pivoting of the first arm member 222 incidentally causes the supporting shaft 46 (48, 50 or 52) to pivot, and the second arm member 226 fixed to the supporting shaft 46 (48, 50 or 52) is also pivoted clockwise in FIG. 5 as viewed from right bottom. Thus, the pivot member 228 connected to the second arm member 226 by the relatively strong tension spring 240 is also pivoted clockwise in FIG. 9. The anchoring pin 250 implanted in the development housing 86 (88, 80 or 82) is inserted through the anchoring channel 248 of the pivot member 228. The development housing 86 (88, 90 or 92) is also pivoted clockwise in FIG. 9 about the supporting shaft 46 (48, 50 or 52) according to the above pivoting of the pivot member 228. As a result, the positioning discs 252 of the development housing 86 (88, 90 or 92) are contacted with the peripheral surface of the rotating drum 16 and the development mechanism 78 (80, 82 or 84) is held at the operative position with regard to the rotating drum 16. Even after the positioning discs 252 have been contacted with the rotating drum 16, the second arm member 226 is kept pivoting slightly clockwise as viewed from right bottom in FIG. 5. This pivoting of the second arm member 226 is compensated for by some pulling and stretching of the tension spring 240. When the movable frame member 42 is elevated or lowered to move the development mechanism 78 (80, 82, or 84) from the developing zone 136, the first arm member 222 is separated away from the movable member 212. As a result, the pivot member 228 is pivoted to the position shown by the two-dot chain line in FIG. 9 by the elastic biasing action of the tension spring 246. The development mechanism 78 (80, 82 or 84) is also pivoted to the non-operative position shown by the two-dot chain line in FIG. 9. When the development mechanism 76 (80, 82 or 84) is pivoted to the non-operative position, the positioning discs 252 depart from the peripheral surface of the rotating drum 16, and the development mechanism 78 (80, 82 or 84) no longer interferes with the rotating drum 16. When the pivot member 228 pivots to the position shown by the two-dot chain line in FIG. 9, the first arm member 222, the second arm member 226, and the supporting shaft 46 (49, 50 or 52) to which they are fixed are pivoted or rotated counterclockwise in FIG. 9 to an angular position at which the protrusion 232 formed in the second arm member 226 comes into contact with the right side edge of the opening 236 formed in the pivot member 228.

Figure 10:
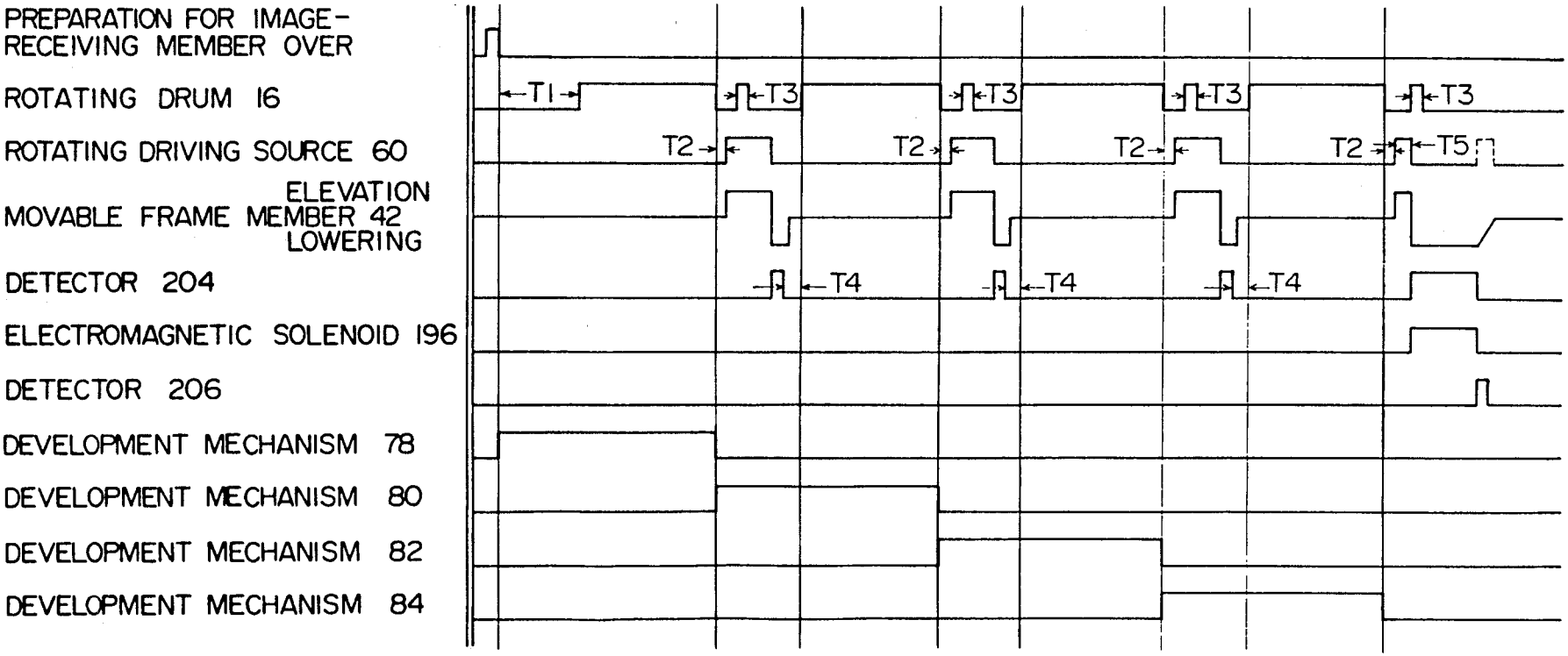
FIG. 10 is a time chart showing the operating procedure of the main constituent elements in the color image-forming machine shown in FIG. 1.

Now, by reference mainly to the time chart shown in FIG. 10, the relation between the rotation of the rotating drum 16 (and therefore, the movement of the electrostatic photosensitive member) and the operation of the developing device 8 will be described.

When an image-receiving member fed from the cassette 30, 32 or 34 is wrapped about the peripheral surface of the rotating drum 22, a signal showing the completion of getting the image-receiving member ready is produced. As a result, in the developing device 8 held at the initial portion (at which the uppermost development mechanism 78 is positioned in the developing zone 136), the driving source 137 for the development mechanisms 78, 80, 82 and 84 is energized, and the control clutch 164 relating to the development mechanism 78 is connected. Thus, the operation of the development mechanism 78 (the operation of the developer applicator means 102, the first agitating means 104 and the second agitating means 106) is started. Then, when a predetermined period of time T1 has elapsed, the rotating drum 16 begins to rotate, and the steps of forming an image regarding the first color, i.e., yellow (namely, the formation of a latent electrostatic image, the developing of the image to a toner image by the development mechanism 78, the transfer of the toner image to an image-receiving member in the form of a rotating drum 22 for transfer, and the operation of the cleaning device 18) are successively carried out. During the time T1 which elapses until the image-forming steps in regard to yellow are stated, the developer is preliminary agitated and "aged" in the development mechanism 78 by the first agitating means 104 and the second agitating means 106.

When the image-forming steps relating to yellow come to an end, the rotation of the rotating drum 16 is stopped. At the same time, the control clutch 164 in relation to the development mechanism 78 is rendered non-connecting and the operation of the developing mechanism 78 is stopped. Furthermore, the control clutch 164 in relation to the development mechanism 80 is connected and the operation of the development mechanism 80 is started. Then after the lapse of some period of time T2, the driving source 60 for the movable frame moving means 58 is energized to start elevation of the movable frame member 42 of the developing device 8. When the movable frame member 42 is elevated over a predetermined distance, the supporting shaft 48 of the development mechanism 80 acts on the anchoring member 182 disposed in the stationary frame member 10 to pivot it to the non-anchoring position shown by the two-dot chain line in FIG. 8 from the anchoring position shown by the solid line in FIG. 8. As a result, the detector 204 detects the detection piece 188 of the anchoring member 182, and produces a signal. Then, the driving source 60 for the movable frame member moving means 58 is deenergized, and the movable frame member 42 begins to descend by its own weight. Immediately after the detector 204 has produced the signal, the supporting shaft 48 of the development mechanism 80 passes the anchoring member 182, and therefore, the anchoring member 182 returns to the anchoring position shown by the solid line in FIG. 8. When the movable frame member 42 has descended over a predetermined distance, the supporting shaft 48 of the development mechanism 80 makes contact with the upper surface of the anchoring member 182 which has returned to the anchoring position. Thus, the descending of the movable frame member 42 is stopped, and the development mechanism 80 is positioned in the developing zone 136.

After the elevation of the movable frame member 42 is started as above (therefore, after the development mechanism 78 positioned in the developing zone 136 starts to move from the developing zone 136) and before the descending of the movable frame member 42 as above is stopped (therefore, before the next development mechanism 80 is positioned in the developing zone 136), the rotating drum 16 is additionally rotated only for some period of time T3. As a result of this additional rotation of the rotating drum 16, that portion of the electrostatic photosensitive member on the rotating drum 16 which existed in the developing zone 136 when the previous development mechanism 78 existed in the developing zone 136 is moved downwardly of the developing zone 136. Frequently, the developer filled in the previous development mechanism 78 remains in that portion of the electrostatic photosensitive member, particularly at those sites with which the flexible members 132 and 134 (FIG. 5) of the development mechanism 78 were in contact. Hence, if the next development mechanism 80 is positioned in the developing zone 136 without additionally rotating the rotating drum, the developer in the previous development mechanism which remains in the electrostatic photosensitive member is likely to get into the next development mechanism 80. When the rotating drum 16 is additionally rotated as above, the above portion of the electrostatic photosensitive member is moved downstream of the developing zone 136 before the next development mechanism 80 is positioned in the developing zone 136. Accordingly, it is not likely to come into the developing zone 136 after it has undergone the action of the cleaning device 18. The developer in the previous development mechanism 78 is accurately prevented from getting into the next development mechanism.

After the lapse of a predetermined period of time T4 from the detection of the detection piece 188 of the anchoring member 182 by the detector 204, the rotation of the rotating drum 16 is started, and an image-forming process in regard to the second color, i.e. red (magenta), is carried out. During the time from the starting of the operation of the development mechanism 80 to the starting of the image-forming process in regard to red, the developer in the development mechanism 80 is preliminarily agitated ("aged") by the first agitating means 104 and the second agitating means 106.

When the image-forming process relating to red comes to completion, the rotation of the rotating drum is stopped. The control clutch 164 relating to the development mechanism 80 is rendered non-connecting, and the operation of the development mechanism 80 is stopped. At the same time, the control clutch 164 relating to the development mechanism 82 is connected, and the operation of the development mechanism 82 is started. Then, by the same procedure as that described above, the third development mechanism 82 is positioned in the developing zone 136, and an image-forming process relating to the third color, i.e. blue (cyan), is carried out. Likewise, the lowermost development mechanism 84 is thereafter positioned in the developing zone 136, and a color-forming process relating to the fourth color, i.e. black, is carried out.

When the image-forming process for the fourth color, black, comes to an end, the rotation of the rotating drum 16 is stopped. Furthermore, the control clutch 164 relating to the development mechanism 84 is rendered non-connecting, and the driving source 137 for the development mechanisms 78 to 84 is deenergized. Then, after the lapse of some period of time T2, the driving source 60 for the rotation of the movable frame member moving means 58 is energized for a predetermined period of time T5. As a result, the movable frame member 42 is slightly elevated, and the supporting shaft 52 of the development mechanism 84 moves away upwardly from the anchoring member 182. Thereafter, the electromagnetic solenoid 196 is energized to pivot the anchoring member 182 to the non-anchoring position shown by the two-dot chain line in FIG. 8. At this time, the driving source 60 for the movable frame member moving means 58 is deenergized, and the movable frame member 42 descends by its own weight. When the movable frame member 42 descends near to the initial position mentioned above, the detector 206 disposed in the stationary frame member 10 detects the detection piece 208 of the movable frame member 42 and produces a signal. Thus, a braking force is produced by producing a driving force in a direction to elevate the movable frame member 42, for example, in the driving source 60, and the descending of the movable frame member is properly braked. Simultaneously, the electromagnetic solenoid 196 is deenergized to bring the anchoring member 182 back to the anchoring position shown by the solid line in FIG. 8. As a result, the lowering of the movable frame member 42 is stopped at the initial position at which the supporting shaft 46 of the lowermost development mechanism 78 makes contact with the upper surface of the anchoring member 182, and the movable frame member 42 is held at the initial position. While the movable frame member is lowered to the initial position as above, the rotating drum 16 can be rotated additionally for a predetermined period of time T3.

While the present invention has been described in detail with respect to preferred embodiments of the color image-forming machine of the invention taken in conjunction with the accompanying drawings, it should be understood that the present invention is not limited to these specific embodiments, and various changes and modifications are possible without departing from the scope of the invention described and claimed herein.

What we claim is:

1. A color image-forming machine comprising:

a developable member which is movable through a developing zone for development, a latent electrostatic image-forming means, and a developing device for developing a latent electrostatic image formed on the developable member, the developing device including a movable frame member, a means for moving the movable frame member, and a plurality of development mechanisms mounted on the movable frame member, each of the development mechanisms being adapted to be selectively positioned in the developing zone by moving the movable frame member, and each of the development mechanisms having a developer agitating means, and each of the development mechanisms having a developer that has toner which is a different color from the toner associated with the other development mechanisms, the movable frame member having a driving source and a means for drivingly connecting the driving source to the agitating means of each of the development mechanisms, the drivingly connecting means including a plurality of control clutches disposed between the driving source and the agitating means of each of the development mechanisms, whereby the agitating means can be selectively driven even during movement of the movable frame member and control means for controlling the developing device by moving the movable frame member to position the development mechanisms at the developing zone in a predetermined sequence, and maintaining the control clutch of one of the development mechanisms in a connected state as the movable frame member begins to move to position said one development mechanism in the developing zone, until the movement of the movable frame member stops.

2. The color image-forming machine of claim 1 in which each of the development mechanisms include a developer applicator means for applying a developer held on its surface to the member to be developed; the developer applicator means of each developer mechanism is drivingly connected to the driving source by the drivingly connecting means; and each of the control clutches is disposed between the driving source and said each applicator means.

3. The color image-forming machine of claim 1 in which the control means maintains the specific control clutch relating to the specific development mechanism positioned in the developing zone in the non-connected state before it again starts the movement of the movable frame member.

4. The color image-forming machine of claim 1 in which each of the development mechanisms is mounted on the movable frame member such that it can pivot about a predetermined pivot axis as a center between an operative position and a non-operative position, and is constructed such that it can develop the member to be developed when it is positioned in the developing zone and at the operative position by the movement of the movable frame member; and the drivingly connecting means includes rotating elements mounted respectively on the development mechanisms so that each can rotate about the predetermined pivot axis of each development mechanism.

5. The color image-forming machine of claim 1 in which a developer to be loaded into each of the development mechanisms contains a toner and a carrier.

6. A color image-forming machine comprising:

a developable member which is movable through a developing zone for development, means for forming a latent electrostatic image on the developable member, a developing device for developing a latent electrostatic image formed on the developable member, the developing device including a stationary frame member, a movable frame member disposed on the stationary frame member to be vertically movable with respect to the stationary frame member, means for moving the movable frame member, the moving means comprising a wrapping transmission mechanism including a rotating driving source which is rotated in a predetermined direction when the movable frame member is to be elevated, and when the movable frame member is to be lowered, the rotating driving source is temporarily deenergized and the weight of the movable frame member is utilized for the lowering thereof, a plurality of development mechanisms mounted on the movable frame member, each of the development mechanisms including a developer that has toner which is a different color from the toner associated with the other development mechanisms, and each of the development mechanisms being adapted to be selectively positioned in the developing zone by moving the movable frame member, an anchoring member movable between an anchoring position and a non-anchoring position, means for selectively positioning the anchoring member at the anchoring position of the non-anchoring position, the anchoring member and the means for positioning the anchoring member being mounted on the stationary frame member, and a plurality of anchor members being mounted on the movable frame member and respectively associated with the development mechanisms, the development mechanisms and the anchor members being spaced-apart in vertical relation in the moving direction of the movable frame member, whereby when an anchor member associated with one of the development mechanisms contacts the anchoring member held at the anchoring position by lowering of the movable frame member, said one development mechanism is positioned in the developing zone.

7. The color image-forming machine of claim 6 in which said anchoring member positioning means is comprised of an elastically biasing means for elastically biasing the anchoring member to the anchoring position and an anchor releasing means for moving the anchoring member to the non-anchoring position against the elastic biasing action of the elastically biasing means; and when the movable frame member is moved in a direction opposite to said specific direction, each of the anchor members acts on the anchoring member and by moving the anchoring member from the anchoring position toward the non-anchoring position against the elastic biasing action of the elastically biasing means, each anchor member can pass the anchoring member, but when the movable frame member is moved in said specific direction, the movement of the movable frame member in said specific direction is hampered by the contacting of any one of the anchor members with the anchoring member held at the anchoring position unless the anchoring member is moved to the non-anchoring position by the anchor releasing means.

8. The color image-forming machine of claim 6 in which a control means is disposed for controlling the action of the developing device; the control means gradually elevates the movable frame member over every required distance from the initial position at which the uppermost developing mechanism is positioned in the developing zone, and then continuously lowers the movable frame member from the final position at which the lowermost development mechanism is positioned in the developing zone to the initial position; and the control means produces a braking force in the rotating driving source at least in the final part of the time during which the movable frame member is lowered continuously from the final position to the initial position.

9. A color image-forming machine comprising:

a developable member which is to be moved through a developing zone, wherein said developable member is an electrostatic photosensitive member disposed on the peripheral surface of a rotating drum, means for forming a latent electrostatic image on the photosensitive member, and a developing device for developing the latent electrostatic image formed on the photosensitive member, the developing device including a stationary frame member, a movable frame member movable mounted on the stationary frame member, means for moving the movable frame member, a plurality of development mechanisms mounted on the movable frame member, the development mechanisms respectively having developers with different color toners, and each of the development mechanisms being adapted to be selectively positioned in the developing zone by moving the movable frame member, an anchoring member movable between an anchoring position and a non-anchoring position, means for selectively positioning the anchoring member at the anchoring position or the non-anchoring position, the anchoring member and the means for positioning the anchoring member being mounted on the stationary frame member, a plurality of anchor members disposed on the movable frame member in respective association with the development mechanisms, the anchor members each comprising a substantially horizontally-extending supporting shaft, the development mechanisms and the anchor members being mounted on the movable frame member in spaced-apart relationships in the moving direction of the movable frame member, and each of the development mechanisms being pivotable on its respective supporting shaft between an operative and a non-operative position, and each of the development mechanisms being adapted to develop the photosensitive member when each is positioned in the developing zone and in the operative position, forcing means for elastically forcing a development mechanism positioned in the developing zone to the operative position, each of the development mechanisms being held at the non-operative position when each is moved from the developing zone and no longer undergoes the action of the forcing means, and a positioning disc rotatably mounted on each of the development mechanisms, each positioning disc being mounted such that when the forcing means elastically forces a development mechanism positioned in the developing zone to the operative position, the peripheral surface of the positioning disc of the development mechanism forced by the forcing means is brought into contact with the peripheral surface of the rotating drum.

10. The color image-forming machine of claim 9 in which the forcing means includes a movable member which is moved according to the movement of the anchoring member.

11. A color image-forming machine comprising:

a developable member which is movable through a developing zone for development, the developable member being an electrostatic photosensitive member disposed on a peripheral surface of a rotating drum, means for forming a latent electrostatic image on the photosensitive member, and a developing device for developing a latent electrostatic image formed on the photosensitive member, the developing device including:

a stationary frame member, a movable frame member movable mounted on the stationary frame member, means for moving the movable frame member, a plurality of development mechanisms mounted on the movable frame member, the development mechanisms having developers containing different color toners, and each of the development mechanisms being adapted to be selectively positioned in the developing zone by moving the movable frame member, each of the development mechanisms being mounted on the movable frame member so that it is free to move between an operative position and a non-operative position, each of the development mechanisms being constructed such that when it is positioned in the developing zone and at the operative position by the movement of the movable frame member, it can effect development of the photosensitive member, a positioning disc rotatably mounted on each of the development mechanisms, and means for elastically forcing a development mechanism positioned in the developing zone to the operative position, whereby the peripheral surface of the positioning disc thereof is brought into contact with the peripheral surface of the rotating drum, the development mechanism being held at its non-operative position when the mechanism is moved from the developing zone and no longer undergoes the action of the forcing means.

12. The color image-forming machine of claim 11 in which an anchoring member adapted to be moved between an anchoring position and a non-anchoring position and a means for selectively positioning the anchoring member at the anchoring or the non-anchoring position are mounted on the stationary frame member, a plurality of anchor members are disposed on the movable frame member in relation to the development mechanisms respectively, the development mechanisms and the anchor members are mounted on the movable frame member in spaced-apart relationship in the moving direction of the movable frame member, when one of the anchor members is contacted with the anchoring member held at the anchoring position by moving the movable frame member in a predetermined direction, a particular development mechanism relating to the anchor member in contact with the anchoring member is positioned in the developing zone, and the forcing means also includes a movable member which is moved according to the movement of the anchoring member.

13. The color image-forming machine of claim 12 in which said anchoring member positioning means is comprised of an elastically biasing means for elastically biasing the anchoring member to the anchoring position and an anchor releasing means for moving the anchoring member to the non-anchoring position against the elastic biasing action of the elastically biasing means; and when the movable frame member is moved in a direction opposite to said specific direction, each of the anchor members acts on the anchoring member and by moving the anchoring member from the anchoring position toward the non-anchoring position against the elastic biasing action of the elastically biasing means, each anchor member can pass the anchoring member, but when the movable frame member is moved in said specific direction, the movement of the movable frame member in said specific direction is hampered by the contacting of any one of the anchor members with the anchoring member held at the anchoring position unless the anchoring member is moved to the non-anchoring position by the anchor releasing means.

14. The color image-forming machine of claim 12 in which the movable frame member is mounted on the stationary frame member vertically movably; the development mechanisms and the anchor members, spaced vertically from each other, are mounted on the movable frame member; and the movement of the movable frame member in said specified direction is lowering and its movement in the opposite direction is elevation.

15. The color image-forming machine of claim 14 in which the movable frame member moving means is comprised of a wrapping transmission mechanism including a rotating driving source; and when the movable frame member is to be elevated, the rotating driving source is rotated in a predetermined direction, and when the movable frame member is to be lowered, the rotating driving source is temporarily deenergized and the own weight of the movable frame member is utilized.

16. The color image-forming machine of claim 15 in which a control means is disposed for controlling the action of the developing device; the control means gradually elevates the movable frame member over every required distance from the initial position at which the uppermost developing mechanism is positioned in the developing zone, and then continuously lowers the movable frame member from the final position at which the lowermost development mechanism is positioned in the developing zone to the initial position; and the control means produces a braking force in the rotating driving source at least in the final part of the time during which the movable frame member is lowered continuously from the final position to the initial position.

* * * * *